US006604993B1

(12) United States Patent
Boniface

(10) Patent No.: US 6,604,993 B1
(45) Date of Patent: Aug. 12, 2003

(54) AIR PARTITION MEMBER AND AIR PASSAGEWAY SYSTEM

(76) Inventor: Andrew Boniface, 23 Franklin La., Kinnelon, NJ (US) 07405

( * ) Notice: Subject to any disclaimer, the term of this patent is extended or adjusted under 35 U.S.C. 154(b) by 0 days.

(21) Appl. No.: 10/122,809

(22) Filed: Apr. 15, 2002

(51) Int. Cl.[7] ..... F24F 7/007
(52) U.S. Cl. ..... 454/186; 165/168
(58) Field of Search ..... 454/186, 185; 165/168, 169

(56) References Cited

U.S. PATENT DOCUMENTS 3,303,770 A * 2/1967 Anthony ..... 454/186
3,516,347 A * 6/1970 May ..... 454/185
5,345,779 A * 9/1994 Feeney ..... 62/259.2
5,468,184 A * 11/1995 Collier ..... 454/186

* cited by examiner

*Primary Examiner*—Derek Boles
(74) *Attorney, Agent, or Firm*—W. Patrick Quast, Esq.

(57) ABSTRACT

An air partition member used to form an air passageway in an HVAC system, includes a rectangular first section; a second section, pivotally connected to the first section, and adapted to contact the floor and compensate for the effect of the irregular planarity in the local area; and, a third section integral with the first section along a dividing line. The third section includes a pleated segment, adaptable to adjust the vertical height of the air partition member so as to compensate for the effect of the irregular planarity of the top surface of the sub-floor over the breadth of the work site.

The basic air partition member can be shaped and contoured to form inside or outside corners of the air passageway and to include appropriate openings, as required, to vent the conditioned air to the work site and to allow for the passage of electrical wires or the like through and across the air passageway.

14 Claims, 7 Drawing Sheets

40
120
122
38
42
50
44
36
46
116
118
32
112
52
124
114
54
110
86
114
56
80
60
58
90
48
98
94
88
104
100
28
24
106
96
30
22
108
103
102

122
86
84
110
120
118
112
80
32
52
82
54
6
56
128
88
100
126
102
96
6
30

AIR PARTITION MEMBER AND AIR PASSAGEWAY SYSTEM

FIELD OF THE INVENTION

This invention relates generally to HVAC systems for use in typically, commercial facilities and like applications and more particularly, to an improved HVAC, air partition member and air passageway system for such facilities.

BACKGROUND OF THE INVENTION

Raised floors are commonly employed in commercial facilities such as offices, computer rooms and stock exchanges. A typical raised floor system consists of a series of floor panels supported at a pre-determined height above the sub-floor by vertical pedestals. The floor panels are supported by stringers which run between the pedestals to form a grid-like system. The raised floor serves as the working floor for the facility. The space between the raised floor and the sub-floor is used to accommodate heating, ventilating and air conditioning (HVAC); electrical cables; fiber optic lines; pipes; and other utility services for the facility. Openings are formed in the raised floor to access the various services at desired locations. Organizing the utility services in pre-determined routes below the raised floor is advantageous because it provides a clean and uncluttered working space on the raised floor.

In some cases, the entire volume below the raised floor acts as a plenum or passageway for purposes of providing the HVAC requirements. Other configurations include individual plenums defined by two vertical sides; plenums including a third, horizontal side parallel to and immediately below the raised floor itself; and four sided systems. The present invention is an improved two-sided plenum, which utilizes the raised floor and sub-floor to define the horizontal planes of the plenum.

Heretofore, in plenum systems employing vertical sides, there have been at least three interfaces of the forming elements where appropriate sealing, typically accomplished by so-called duct tap or caulking is necessary to minimize leakage. One such system includes plenum baffle plates disposed between an angle bracket secured to the sub-floor and a formed right angle piece at the top of the baffle "plate" which was secured to the pedestal plate just below the raised floor. Caulking or the use of duct tape is required to seal the interface between the angle bracket and the floor and the angle bracket and the vertical plenum. Typically, gasket-like material is interposed between the formed right section at the top of the vertical baffle, and the raised floor to seal that seam.

In another configuration, two, formed baffle plates substantially identical in shape are employed (see FIG. 3). Each baffle plate (62, 64) includes a vertically disposed first section (66, 68) and an angled section (70, 72). They are mated back to back along their vertical sections. The respective angled section meets either with the sub-floor surface or the under surface of the raised floor. Again pedestal adhesive or other sealing technique sometimes combined with a concrete fastener between the angled plate portion and the sub-floor are used. Gasket-like material is interposed between the angled section of the top element of the plenum and undersurface of the raised floor. The angled section of the upper baffle plate typically is secured to the stringer member using pop rivets. The juncture between the two vertically extending plates is then sealed typically using duct tape and reinforced using pop rivets. Again, in order to be efficient, three mating seams have to be sealed. To compensate for the variations in surface planarity of the sub-floor which can vary up to at least two inches, at the vertically extending plates of a respective pair of baffle plates align themselves to reflect the actual finished floor height above the concrete surface at that specific location before they are taped together.

In certain cases the raised floor panels have to be modified to enhance the seal at the interface between their undersurface and the baffle plates.

The relatively, permanent installation techniques utilized to position, secure and enhance the seals of prior art techniques increase the costs of installation and inhibit the flexibility of altering the paths of such systems.

Another preferable feature of such systems is to standardized the various, partition member components to thereby enable modularization of the passageway design. This allows the system designer to easily alter and optimize the design during the initial layout, as well as later on when changes are required.

It is therefore a primary object of this invention to provide an air partition member suitable for HVAC air passageways which has only two interfaces that must be sealed; that is between the partition member and the sub-floor and between the partition member and the raised floor undersurface, with no horizontal seam in the vertically extending section of the air partition member which defines the sidewall of the passageway.

There is still another object to this invention to provide a series of standard sized and configured shapes which will accommodate practically any air passageway design as may be dictated by a given customer's requirement.

Still another object of the present invention is to provide an air partition member which avoids the need for drilling into, or otherwise anchoring to, or altering either the sub-floor or the raised floor undersurface.

Still yet another object of the present invention to provide an air partition member which by design accommodates the lack of planarity typically experienced along the surface of the sub-floor.

It is still another object of this invention to provide an air partition member that can be employed using existing pedestal-stringer systems.

It is an additional object of this invention to provide an air partition member that conserves manufacturing time and material.

It is still a further object of this invention to provide an air duct passageway system for use below raised floor systems that improves upon the efficiency of HVAC systems by eliminating the horizontal seam in the vertically extending air partition member.

It is but another object of this invention to provide an air duct passageway for use below artificial floor systems that is fool-proof and saves installation time.

It is yet an additional object of his invention to provide an air duct passageway that is easy to maintain and reposition to accommodate desired changes in system layout.

Other objects and advantages of the invention will become apparent upon reading the following description and upon reference to the accompanying drawings.

SUMMARY OF THE INVENTION

A one-piece partition member for use in forming an air passageway in an HVAC system, between a top surface of a sub-floor, the top surface having an irregular contour, and an undersurface of a raised floor positioned on a pedestal-stringer, floor support system is claimed. The air partition member includes a first section which is substantially rectangular in shape.

The member includes a second section, integral with and having a pivotal connection to the first section along a bend line. The second section bears a first angular relationship to the plane of the first section. The member further includes a third section integral with the first section along a dividing line. When the air partition member is in place, the third section extends upward from the second section. The third section includes a first segment, distal from the dividing line and extending substantially, laterally, between the lateral edges of the member. This first segment is adapted and contoured for engagement of at least one of the pedestal or stringer portions of the pedestal-stringer floor support system, to thereby suspend the air partition member substantially vertically between the top surface of the sub-floor and the undersurface of the raised floor. The third section includes a second segment, which is contoured as a pleat and thus adaptable to adjust the vertical height of the air partition member so as to compensate for the effect of the irregular planarity of the top surface of the sub-floor. This compensation is principally directed to the large variations that may occur over an entire work site, for example, ±2 inches about nominal.

The second section is also adapted to contact the top surface of the sub-floor and to compensate for the effect of the irregular planarity of the top surface of the sub-floor by flexing about the pivotal connection. This compensation addresses the relatively minor variations in the sub-floor planarity experienced between pedestals.

The basic air partition member can be shaped and contoured in both the second and third section, to allow for the mating therewith of a second air partition member when used together to form an inside or outside corner of the air passageway.

The air partition members include integral clip means for securing the air partition member to the pedestal so as to prevent bowing of the air partition member when the air partition member is positioned vertically between the top surface of the sub-floor and the under surface of the raised floor and when said HVAC system is operational.

As required, any one air partition member of any of the various designs can include a cutout portion intended to allow air to exit from the air passageway when the HVAC system is operational.

As required, any one air partition member of any of the various designs can include a cutout to allow for the passage of electrical wires or the like through the air partition member, and across the formed air passageway.

Air partition members are used to form an air passageway for an HVAC system. The passageway is defined by the top surface of the sub-floor and the undersurface of the raised floor positioned on the pedestal-stringer, floor support system. The air partition members of the present invention are used to form the two vertical sides of the passageway, which are spaced apart from each other a fixed distance.

BRIEF DESCRIPTION OF THE DRAWINGS

FIG. 7 is an exploded perspective view of a so-called wire-track crossing configuration depicting modification of the air partition member of the present invention so as to accommodate the passageway crossover for electrical wires and the like.

DESCRIPTION OF THE PREFERRED EMBODIMENT

Figure 1:
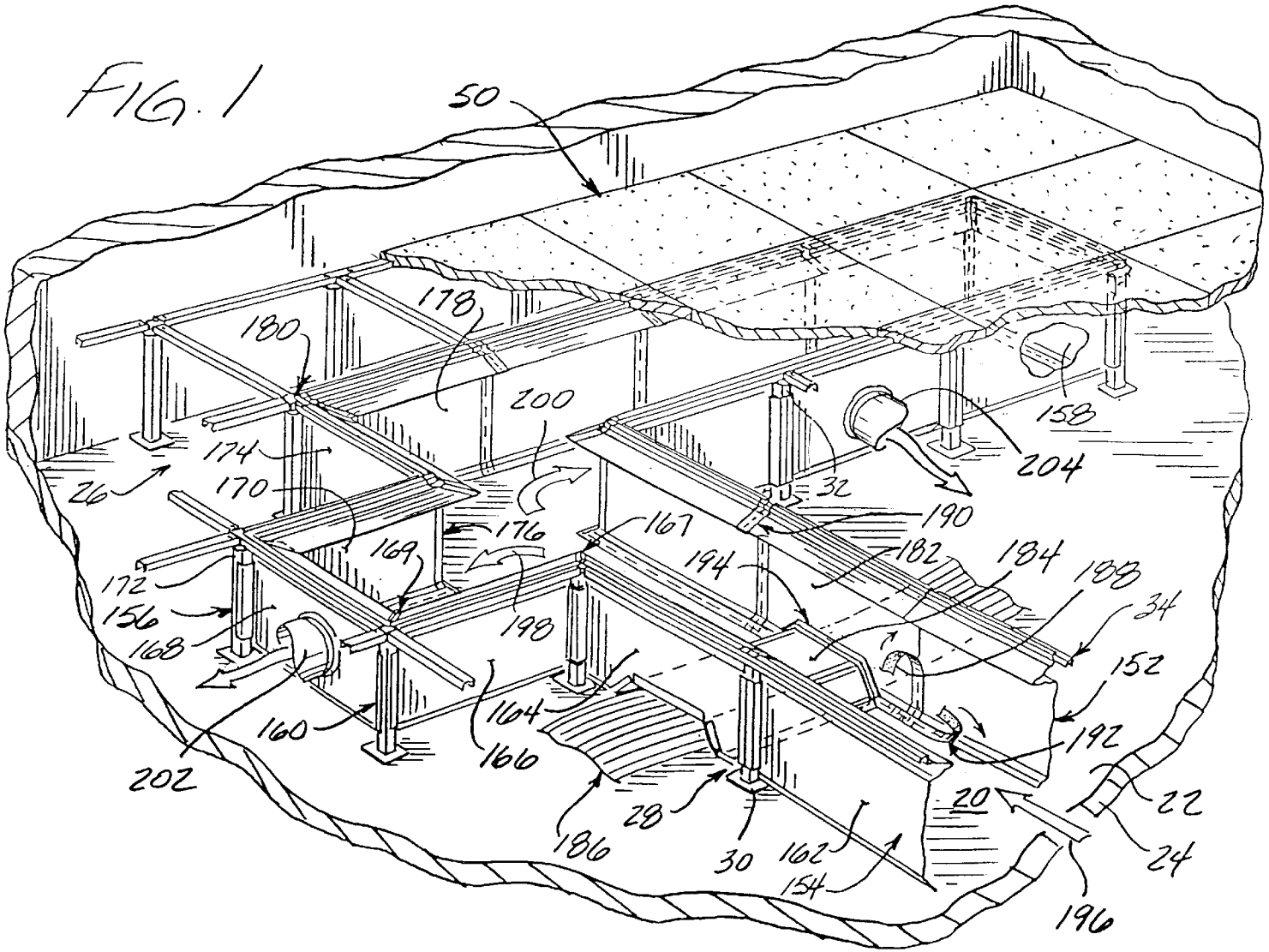
FIG. 1 is a perspective schematic plan view of a portion of a lay out wherein an illustrative segment of the passageway system of the present invention, is shown.
Figure 2:
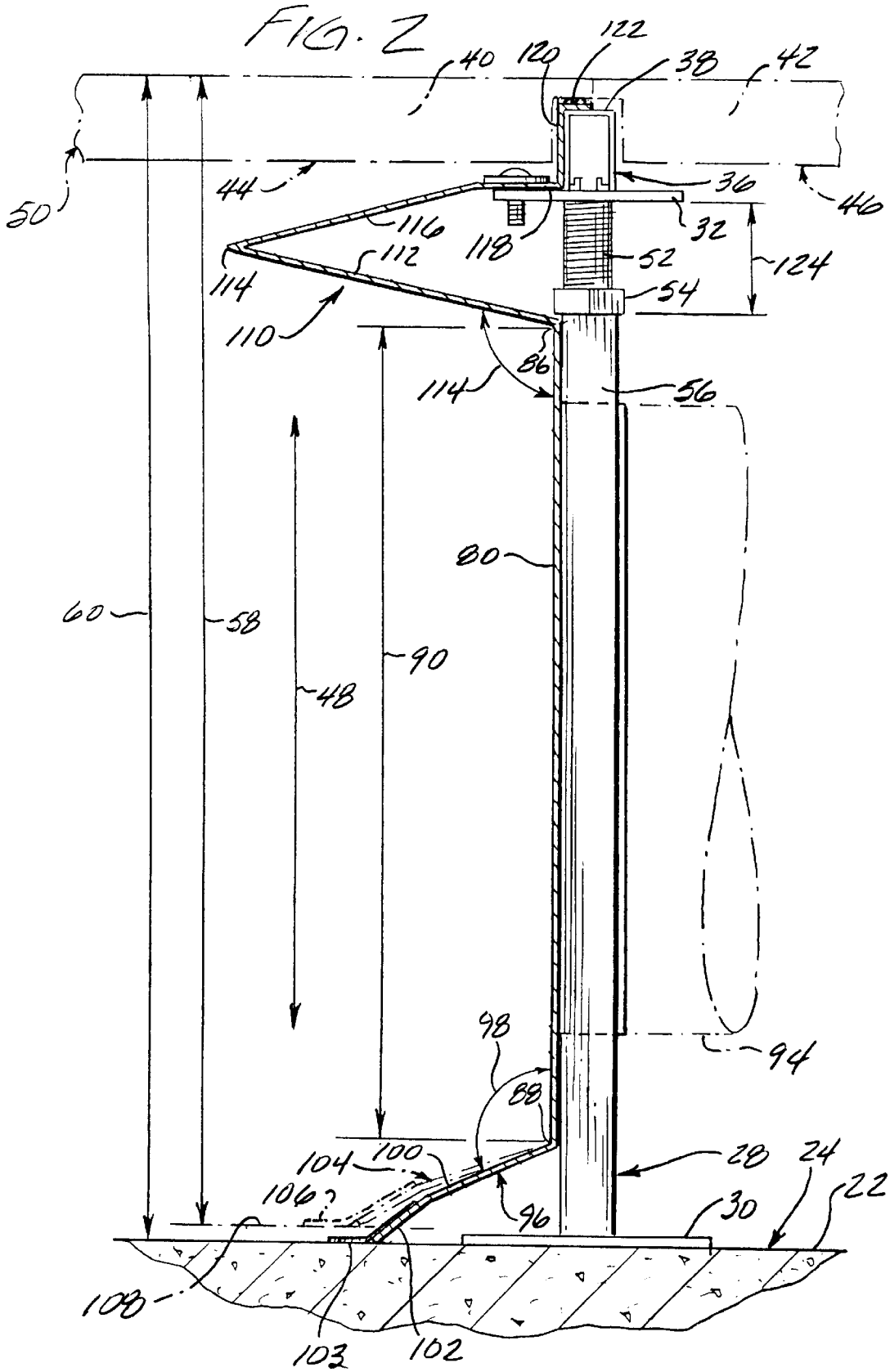
FIG. 2 is an elevation view of a preferred embodiment of the air partition member of the present invention.
Figure 3:
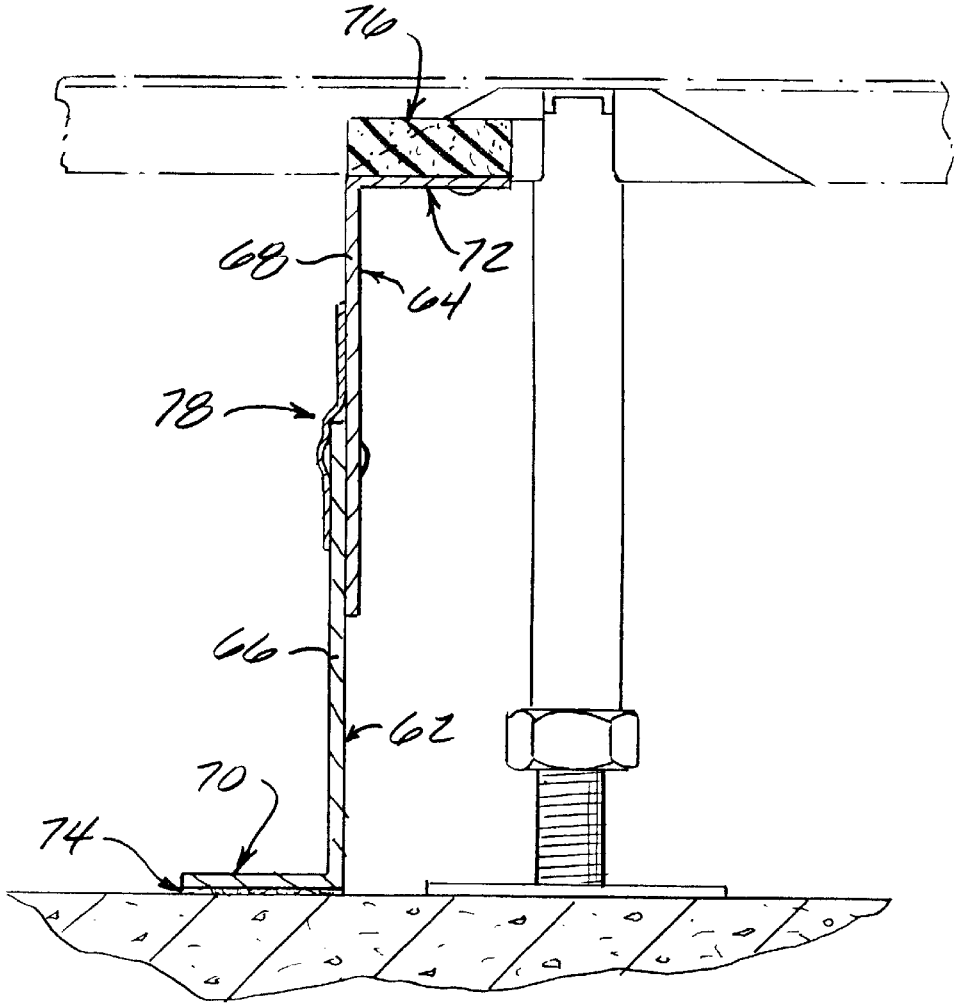
FIG. 3 PRIOR ART
FIG. 3 is an end elevation view of a prior art plenum member.

Referring now to FIGS. 1 and 2, there is depicted an air passageway 20 used to channel the conditioned air driven by the supply air fans forming a part of HVAC system. In a raised floor environment, the passageway 20 is positioned on a top surface 22 of a sub-floor 24. The sub-floor typically is a poured concrete slab. The top surface 22 forms the bottom "side" of the air passageway.

A floor support system 26 includes a plurality of vertically extending pedestals, for example 28, positioned on the top surface of the sub-floor. They are anchored to the sub-floor and are formed in a grid-like pattern, typically on 24 inch centers. The pedestal bases, for example 30, are secured to the concrete slab by suitable anchors.

Disposed across the upper plates, for example 32, of the pedestals is a stringer arrangement 34. Individual standard stringers run, in length, just shy of four feet. They are secured to the upper plates 32 by appropriate fastening means. The stringers are "U" shaped in cross section. They are placed on the upper plates of the pedestals in an inverted position, for example 36 in FIG. 2. The upwardly disposed surface 38 of the inverted stringer provides a support surface area for individual floor tiles, for example 40 and 42. The under surface, for example 44 and 46, of respective individual floor tiles form the upper boundary of the air passageway.

The contour of the top surface 22 of the concrete slab 24 unfortunately lacks planarity. Experience shows that the surface can vary over its area by approximately plus or minus two inches from the desired nominal value. This irregularity must be addressed to insure a level, raised floor.

When the floor system is being installed, the individual pedestals, again, for example 28 in FIG. 2, are adjusted in the vertical direction 48 in a known way, to compensate for these variations in the sub-floor top surface. This provides the means for leveling the raised floor 50. The nominal distance between the top surface of the sub-floor and the under surface of the raised floor 50 typically can be between 12 to 30 inches or more based on the facility developer's requirements. A typical pedestal capable of this vertical adjustment is shown in FIG. 2. It includes a threaded stem 52, a position locking nut 54 and tubular element 56 into which the threaded stem is placed. The vertical height of a particular pedestal is set by rotating the nut 54 on the treaded shaft. This is done for each pedestal in the floor support system. Again, depending on the "local" concrete slab profile, the distance, 58, 60 between the top surface 20 and the under surface, for example, 44, can vary plus or minus two inches over the surface area of the sub-floor from a nominal value.

This variation presents a challenge to the design of the elements forming the air passageway for the HVAC system.

The air partition member of the present invention is formed from a single piece of sheet metal. Where the nominal distance between the top surface of the concrete slab and the under surface of the raised floor is 18 inches, the flattened air partition member reflecting the preferred embodiment design would be approximately 29 inches, top to bottom. This would allow two such pieces to be fabricated from a 60 inch roll at the specific length desired. For greater nominal distances between the slab and the raised floor, the starting top to bottom dimension will be greater.

The gauge of the sheet metal preferably is 26. Twenty-four (24) gauge and 28 gauge will work also with varying degrees of a stiffness based on the gauge. It has been applicant's experience that 22 gauge sheet metal is too heavy and less flexible for the intended application. Thirty (30) gauge generally is too light and flimsy to withstand the rigors of installation and use.

The basic air partition member includes a first section 80. This is typically rectangular in shape. The perimeter of section 80 is formed by lateral edges 82 and 84 and the bend lines 86 and 88. Referring to FIG. 2, the minimum height 90 between the bend lines 86 and 88 is dictated by the diameter of the opening 92 (FIG. 4) and the radial width of a mounting flange associated with the collar 94 positioned over the opening 92. The opening 92 exists in certain adaptations of the basic air partition member to allow air to exit from the air passageway when the HVAC system is operational. For an application again where the distance between the sub-floor and the raised floor is 18 inches, the height 90 would be approximately 13 inches, for an opening 92 having a 10 inch diameter.

Integral to the first section 80 is a second section 96. This section is formed during the manufacturing process by bending the sheet metal at bend line 88 at a predetermined angle. This angle has been largely determined and optimized through experimentation. The applicant has found a successful implementation of the invention if the angle as defined by arc 88 (FIG. 2), is nominally 113 degrees when installed. This angle together with the length of section 96, again for 18 inch clearances, provides the necessary degree of flexibility to compensate for the variations on the surface planarity typically experienced over the length of a partition member.

The length of section 96 includes two segments. Segment 100 is approximately 2.25 inches, again, for the conditions mentioned; and segment 102 is nominally one inch in length. Further, segment 102 is bent in relationship to segment 100 by approximately 15 degrees for a total angular relationship to the vertical, as viewed in FIG. 2, of 128 degrees nominally. Segment 102 facilitates the placement of tape 103 at time of installation.

Shown in phantom in FIG. 2 is the position of the section 96 when the top surface 22, due to the irregularity of the sub-floor, is minimally closer to the raised floor 50 over the distance between partition members. Due to the pivotal connection between the first and second sections along the bend line 88, section 96 is allowed to pivot upward about the bend line 88 and assumes position 104. Segment 102 contacts the top surface 108 at its new elevation 106. Again because of the pivotal connection between the two sections and the appropriate selection of sheet metal gauge, the flexure occurs with minimal force exerted directly in the vertical direction so as to avoid lifting the raised floor.

A third section 110 is formed during the manufacturing process, integral with the first section along the bend line 86. In the preferred embodiment, the third section is formed in a pleated fashion and includes a fifth segment 112 formed at an angle 114 somewhat greater than 90 degrees as measured against the vertical. The material is further formed at point 114 at a small, acute angle. Segment 116 extends back from the bend 114 toward the pedestal 28, again as viewed in FIG. 2. The length of 116 is sufficient to reach the location where the pedestal plate 32 occurs again in the assembled configuration. The segment is further bent to establish a horizontal flange 118 juxtaposed on the flange 32 in the final assembly. The sheet metal is further bent in the vertical to form segment 120, and once again, horizontally, to form segment 122. In the final assembly the horizontal segment 122 rests on the top surface 38 of the inverted stringer member 36.

In the final assembly, with the air partition member joined to a particular pedestal, the distance 124 which, typically, can vary up to 4 inches over the work site, depends on the variation in planarity of the top surface of the concrete slab. The third section's configuration must accommodate this variation, and the pleated design of the preferred embodiment accomplishes this well.

Figure 4:
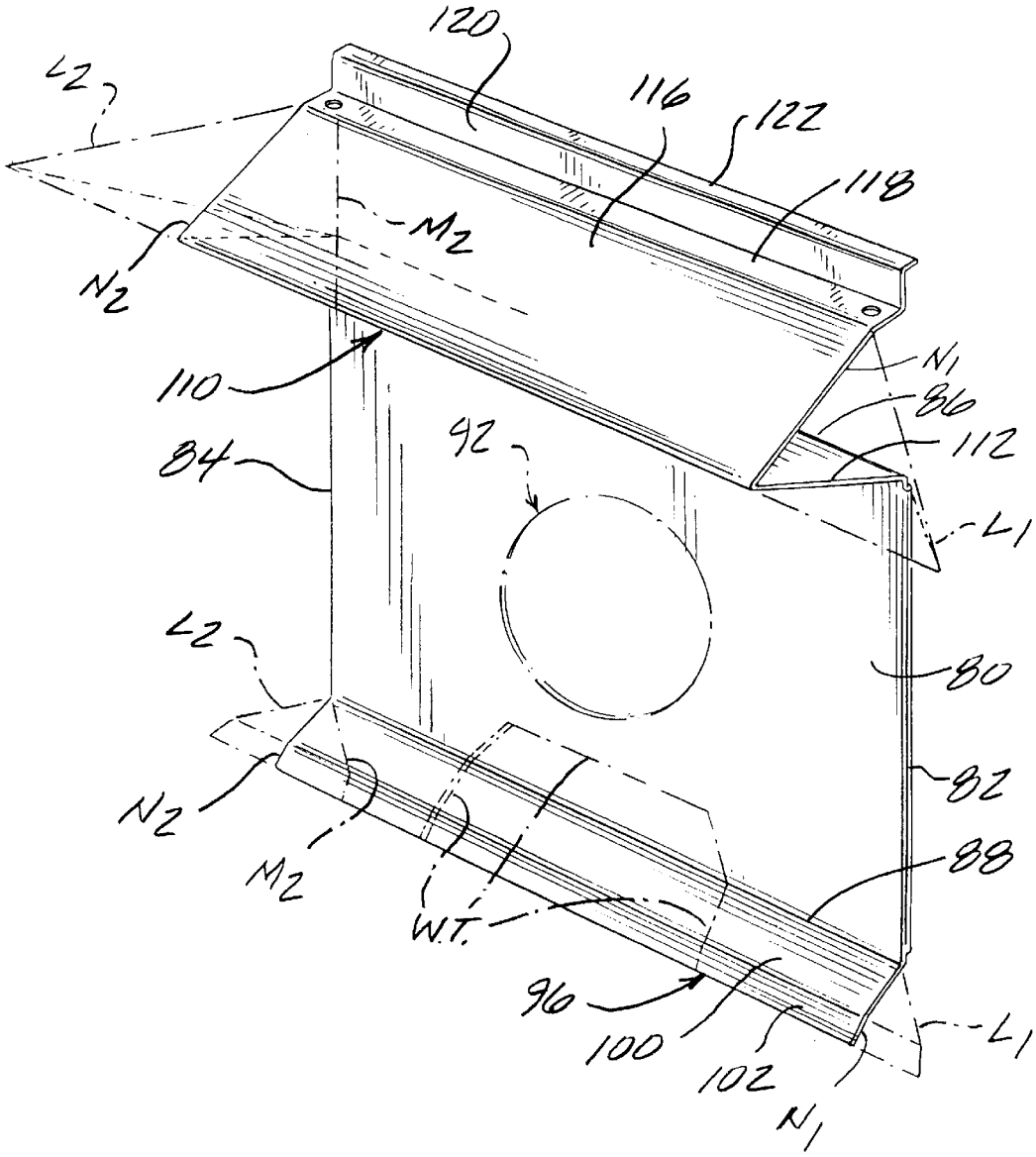
FIG. 4 is a perspective view of the preferred embodiment of the air partition member of the present invention including illustration of the various configurations used to adapt the basic member so as to allow its employment as corner pieces, etc. as may be required throughout an air passageway design.

Referring now to FIG. 4, the basic, air partition member of the present invention is shown by the solid lines. This would be used, or depicted, at varying lengths, to implement the straight runs in an air passageway design. The right edge of the basic member is defined by edge 82, and edges labeled $N_1$, for the second and third sections. The left edge is defined by edge 84, and edges labeled $N_2$, again for the second and third sections. Reflected in the figure, using dash lines, are various adaptations reflecting modifications to the basic member. These will permit the partition member of the present invention to be used in forming necessary inside and outside corners in the air passageway design for a given facility. The applicant identifies a modified, basic member as a "throat" (TH) member when it is shaped and adapted to allow it to form an inside corner; and a "heel" (HE) member when it is used to form an outside corner. A basic member can also be shaped and adapted to form a combined "throat"-"heel" (TH1HE) member where there is a successive outside-inside corner formation in the air passageway design. The opening 92 as noted above is used to allow the exit of the conditioned air from the passageway and can occur on any one of the three types of partitions, i.e. straight, throat or heel pieces.

With respect to a throat member, there are two types necessary to implement the possible combinations in a passageway system design. Referring to FIG. 4, to form a first throat design (TH1), the starting sheet metal material is cut in a way to include additional material at the edges of both the second and third sections. This additional material is provided at the right side of the basic member, as viewed in FIG. 4, extending these edges to the lines, identified by $L_1$. This first version of the throat design does not include additional material at the left edge of the basic member, which is defined for the second and third sections by $N_2$. The edges 82 and 84 of the first section of this version of the throat design are substantially located, in the formed member, where they would be for the basic air partition member.

The second throat design (TH2) is formed from a sheet metal configuration which includes additional material, this time, on the left edges of the second and third sections, again as viewed in FIG. 4. In this version, the left edges for the second and third sections are defined by the lines $L_2$. In this version the right edges of the second and third sections remain substantially as they are in the basic member, here defined by $N_1$. Again edges 82 and 84 are substantially the same as they are in the basic member and the first throat design.

A heel design (HE) variation of the basic design is formed by removing material from the starting sheet metal that would be included in the basic member design. In referring to FIG. 4, the removed material results in a formed left hand edge in sections 2 and 3 identified by the lines $M_2$. The right edge again is defined by lines $N_1$. Edges 82 and 84 are substantially as they are with respect to the previous designs.

A further variation of the basic member is what the applicant refers to as a throat-heel design (TH1HE). In this adaptation, the sheet metal material is removed from the basic member on the left hand edge and added on the right hand edge. As formed, the left hand edge of this variation, would be defined by the lines $M_2$ in the second and third sections; and by the lines $L_1$, in the second and third on the right hand side. Once again edges 82 and 84 are substantially identical to the previous configurations.

FIG. 4 further depicts, again in dotted lines, an additional adaptation of the previously discussed designs. With this modification, any one of the previous designs can be further adapted to allow for the cut-out of material along lines WT. During manufacture, material is removed from the first and second sections by cutting along these lines. This allows for electrical wires and other utility service items to cross the pathway of the air passageway so as to facilitate the distribution of electrical power and the like throughout the work area.

Figure 5:
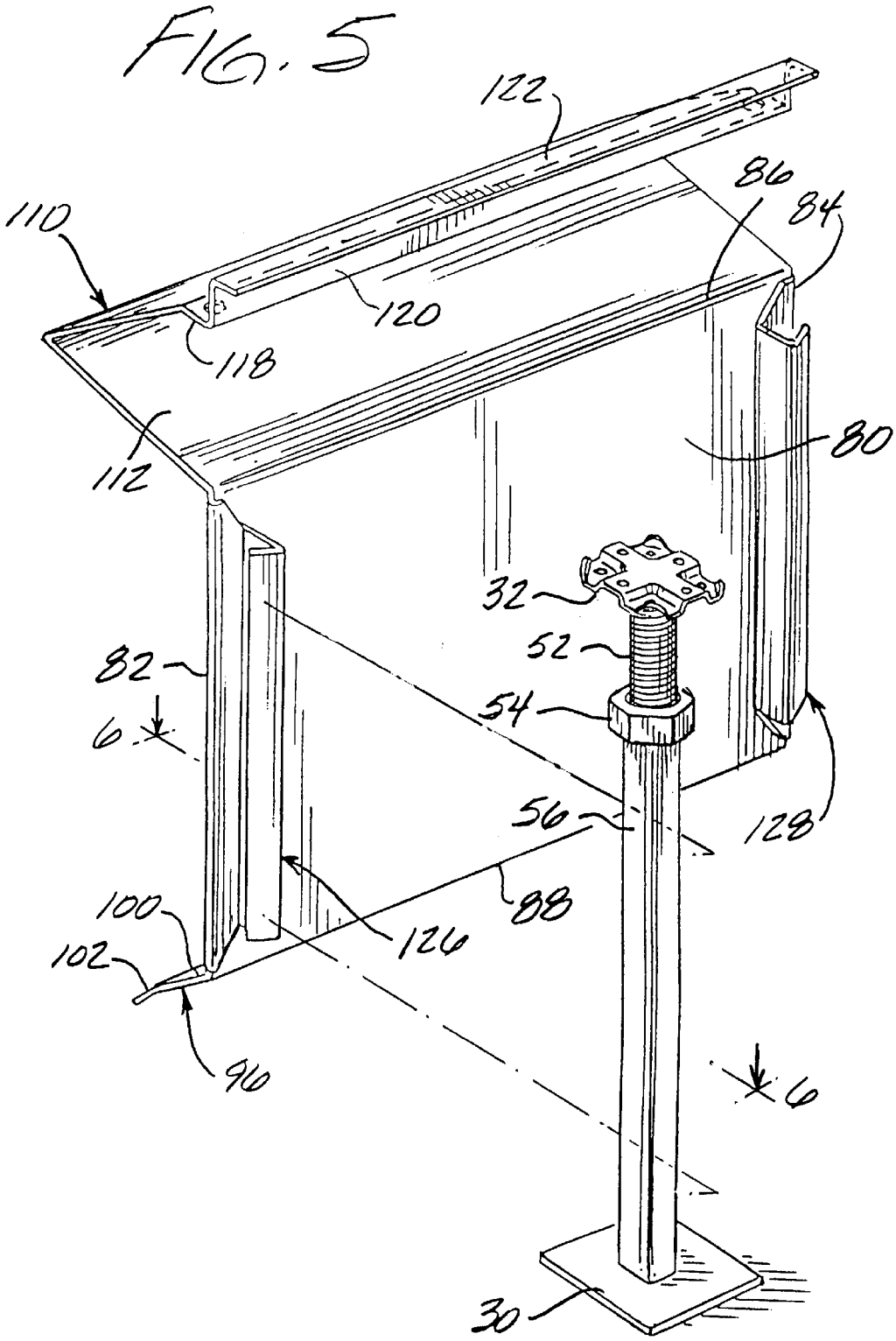
FIG. 5 s a perspective view of the opposite side of the preferred embodiment of the present invention depicting the end clips used to secure the member to the vertical stanchions of the pedestal.
Figure 6:
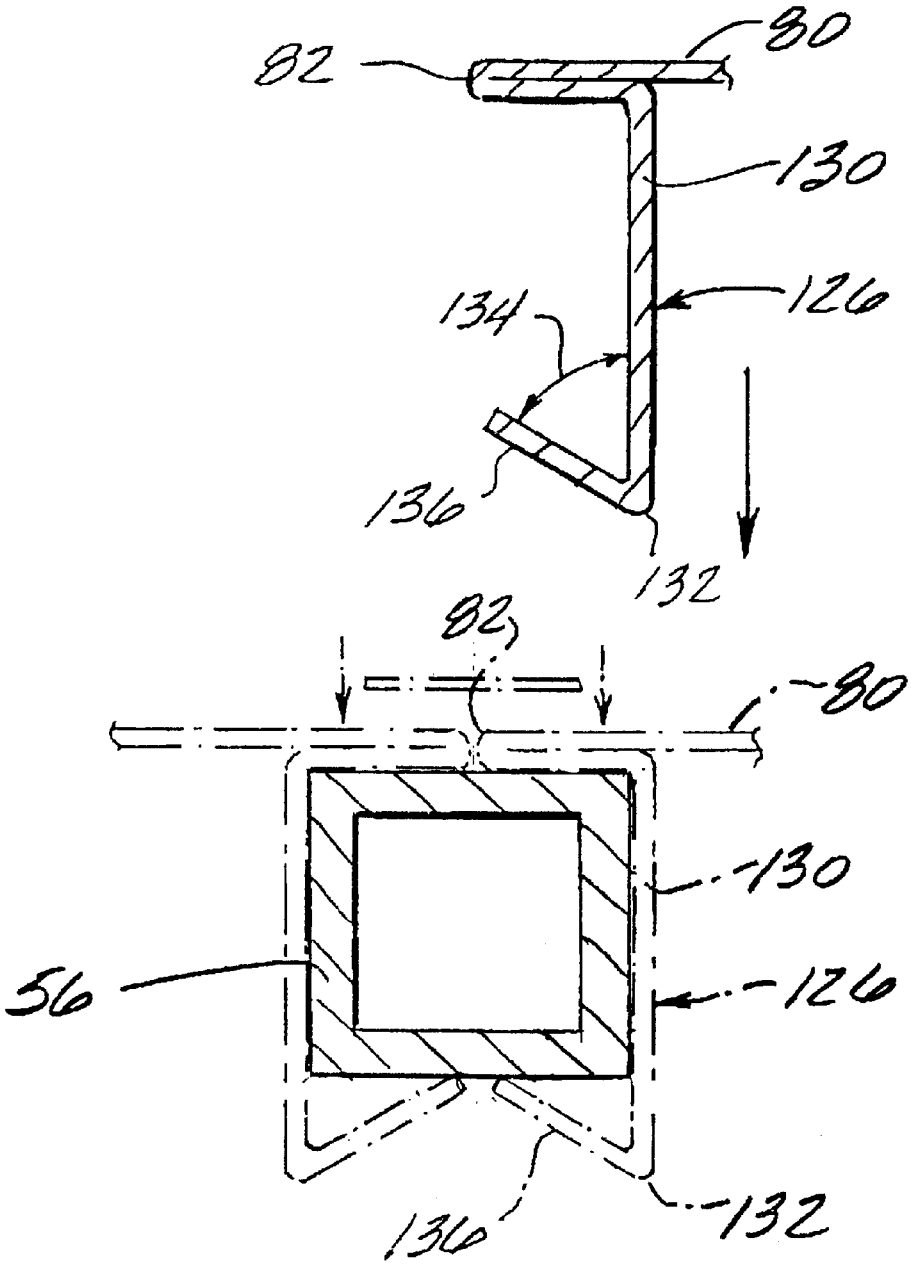
FIG. 6 is a plan view taken along lines 6—6 of FIG. 5.

FIG. 5 depicts the "outside" side of an air partition member, that is the side outboard from the air passageway plenum when assembled. Referring to FIG. 5 and FIG. 6, consistent with the manufacturing efficiencies of the present invention, in the preferred embodiment, end clips 126 and 128 are formed from the same starting sheet metal. For the basic member, material at edges 82 and 84 is bent back against the plane of the first section 80, a short distance, and then at a right angle thereto to form segment 130. Segment 130 extends to an end point 132 where it is then bent inwardly and back toward the plane of section 80 forming an acute angle 134 as defined between segments 136 and 130.

Individual panel members are installed onto a pair of corresponding pedestal, tubular elements 56 by engaging the latter in the direction shown in FIGS. 5 and 6. Given the characteristics of the sheet metal material being used, segment 136 behaves in a spring-clip manner so as to affirmatively engage the pedestal tubular member 56. Since the edges of the various versions of the basic members, as noted above, are substantially identical, this clip arrangement with some minor modifications, works for any of those variations. This positive grasping of the pedestal vertical members ensures that the individual partition members maintain their vertical alignment, without bowing, when the HVAC is operational, and pressurized air moves through the air passageway.

Figure 7:
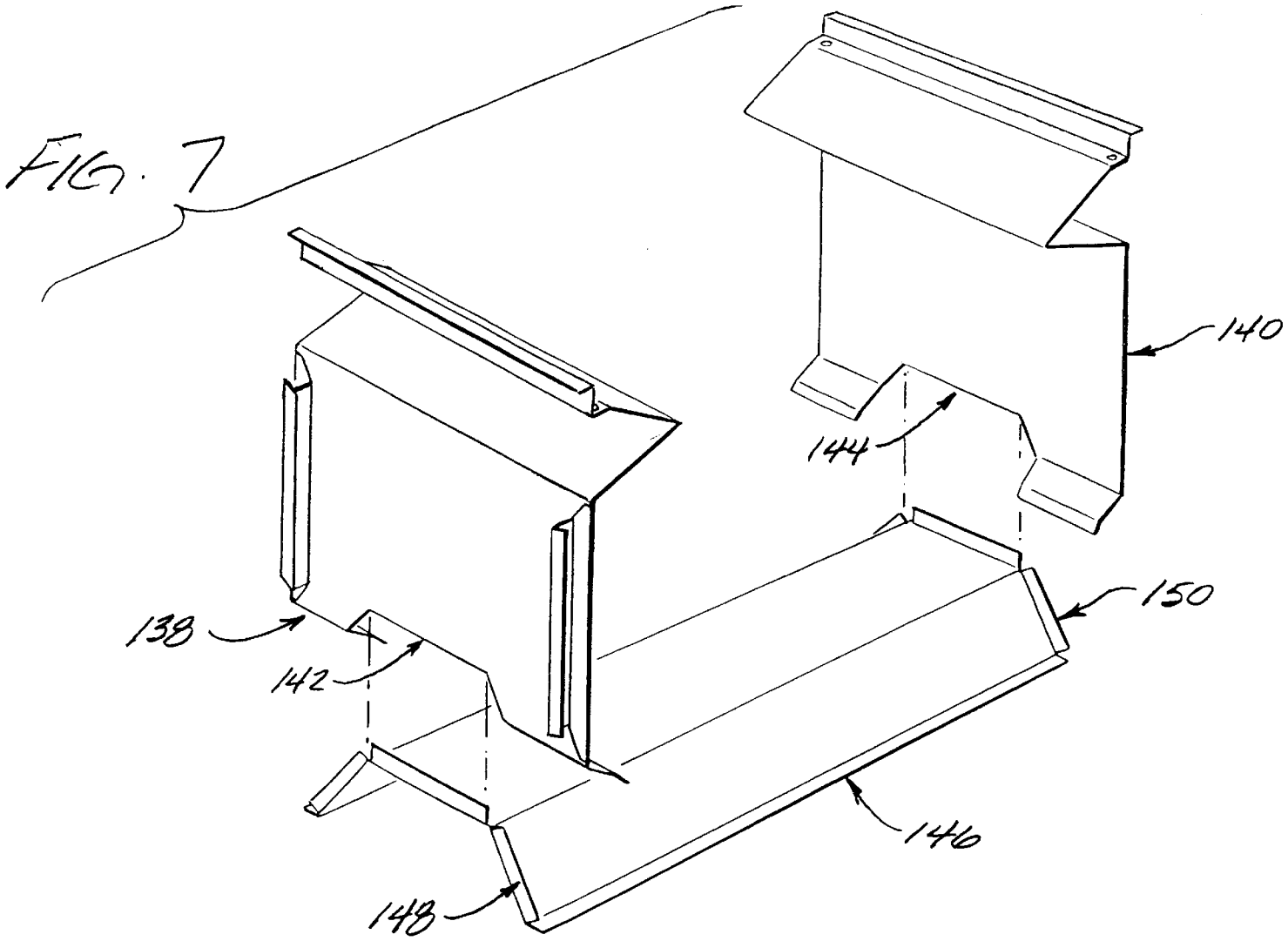

Referring now to FIG. 7, there is depicted a special adaptation of the air partition member of the present invention. Any one of the various type designs disclosed in discussing FIG. 4 can be the subject of this further modification. As shown in FIG. 7, the two partition members 138 and 140, include respective cut-outs 142 and 144 where material has been removed during the fabrication process. This corresponds to the materials in the area defined by the dotted lines WT in FIG. 4. A transition member, 146, is suitably shaped and adapted from sheet metal. Its contour and profile mirror the cut-out of the openings 142 and 144. The transition member 146 includes flanged segments 148 and 150 which will engage the outside surfaces of the partition members, when in place, in a air passageway system. The function of this variation, will be better appreciated from the further, following discussion related to FIG. 1.

Returning to FIG. 1, the air passageway 20 includes a first side 152 comprising air partition members of differing designs as described hereinabove. A second side 154 is spaced apart from the first side by a fixed distance generally equal to the nominal grid spacing, for example 24 inches. As the air passageway system runs the course of the work site area, the first and second sides generally run parallel to each other except where taps, 156, are made to provide conditioned air for a particular location in the work site; or when the passageway is terminated such as by termination partition member 158.

After the pedestal-stringer system is positioned and secured to the surface 22 of the sub-floor, individual pedestals are adjusted to compensate for the lack of planarity over the work site area. As noted above, this variation can run ±2 inches, typically, about a nominal value. Once the work area is cleaned, the assemblers move through the area installing individual partition members in accordance with the design layout. The nature of the unique design of the partition members allow the assembler to install each member by snapping the clip portions of each member onto the tubular segment of the pedestals, for example as shown at 160.

As depicted in FIG. 1, the air passageway system utilizes each of the various type members particularly described above. The system shown includes a straight, basic member 162 which is adjacent a TH1 member 164. The TH1 member joins with a TH2 member 166 to form an inside corner 167. Member 166 then meets member 168 to form an outside corner 169. Member 168 is of the HE design, again configured as noted above. Following the configuration of the second side, member 168 meets member 170 at outside corner 172. Member 170 is configured in the TH1HE design. Member 170 meets member 174 at corner 176 and continues along to meet member 178 at corner 180. Member 174 is of the TH2 design; while member 178 is of the HE design.

Partition member 164 and its opposing member 182, a straight or basic member, have been further modified to allow for the connection of a transition member 184 in a manner similar to that described above in association with FIG. 7. This wire track crossing, transition member, allow for passageway of electrical conduit, 186, through the air passageway system with minimal interruption to the air flow in the passageway.

While straight members are shown in general as only one grid-length in length, typically for longer runs, these pieces will be made from longer lengths of sheet metal so that extended runs will utilize straight partition members of length equal to multiples of the basic grid spacing. Although not typical, it is possible also to fabricate the modified designs in longer lengths. Generally, however, to facilitate the modular concept of the design as implemented by the partition member, as a practical matter, the length of the designs such as the TH1, TH2, HE, and TH1HE are usually kept to the minimum grid spacing, for example, 24 inches.

Once all the air partition members are installed, the assembler then seals all the vertical, horizontal and corner seams with an appropriate tape. So by way of example, tape 188 shows being dressed along the vertical seam between partition member 182 and the member immediately adjacent, on the right, as viewed in FIG. 1. The tape runs the full length of the seam, from floor surface 22 up to the top of the pleated section and above as shown at 190. Tape also runs along the seam between the bottom flange of each of the members and the top surface 22 of the slab, as shown at 192. Segment 102 (see FIG. 2) provides an easy guide to the assembler in running the tape. Tape is also run along the seams between the transition member 184 and the mating partition members 164 and 182, at the mating seams, as for example, shown at 194.

Tape and caulking can be used at other air transitional points between the inside and outside of the air passageway, for example, where the partition member is secured to the pedestal top. A foam strip is positioned on the top surface of segment 122 (see FIG. 2) along the entire length of the passageway where the floor tiles are to contact it. The floor tiles are then installed. The seam between tiles can be sealed with appropriate sealing tape, where they transit over the top of the air passageway.

The air passageway is now defined by the first and second sides formed by the partition members, together with the top surface of the sub-floor and the undersurface of the floor tiles now in place.

Of course in order to be practical, the conditioned air flowing in the directions 196, 198 and 200, must be vented from the passageway to provide the conditioned air to the work site above the raised floor. Respective partition members are modified to include a cut-out such as 92 in FIG. 4 to which is affixed typically air collars such as 202 and 204. Air is directed through these collars and, typically, vented to the interior and perimeter zones of a work site area through a connected flexible duct, a variable valve assembly, plenum and an exit grille.

Thus it can be seen that a unique, partition member lends itself to utilization in designing and implementing a modularized, air passageway system. It is now quite apparent how the basic member, and disclosed alterations can be used to effect an efficient and inexpensive-to-install, configuration.

Although a particular preferred embodiment has been disclosed, it should now be quite apparent to those of ordinary skill in this art, that the ideas implemented by the preferred design can be otherwise implemented without deviation from the breadth of the invention defined by the claims that follow.

What is claimed is:

1. A one-piece partition member for use in forming an air passageway in an HVAC system, between a top surface of a sub-floor, the top surface having an irregular contour, and an undersurface of a raised floor positioned on a pedestal-stringer, floor support system, the air partition member comprising:

(a) a first section having a substantially rectangular shape defined by a perimeter including a first, second, third and fourth line, said first section extending laterally and longitudinally in a first plane between said first and second lines and between said third and fourth lines, said first and second lines defining respective lateral edges of said first section;

(b) a second section, integral with and having a pivotal connection to said first section along said fourth line, said second section bearing a first angular relationship to said first plane; and, (c) a third section integral with said first section along said third line, said third section extending upward from said third line when said air partition member is positioned vertically between the top surface of the sub-floor and the undersurface of the raised floor, said third section including a first segment, distal from said third line and extending substantially, laterally, between said lateral edges, said first segment adapted and contoured for engagement of at least one of the pedestal or stringer portions of the pedestal-stringer floor support system, to thereby suspend said air partition member substantially vertically when said air partition member is positioned vertically between the top surface of the sub-floor and the undersurface of the raised floor, said third section including a second segment, said second segment contoured as a pleat and thereby adaptable to adjust the vertical height of the air partition member so as to compensate for the effect of the irregular planarity of the top surface of the sub-floor, said second section adapted to contact the top surface of the sub-floor and to compensate for the effect of the irregular planarity of the top surface of the sub-floor by flexing about said pivotal connection.

2. The air partition member claimed in claim 1 wherein the contours of each of said second section and said third section, at least, are further shaped and adapted to allow for the mating therewith of a second air partition member when used together to form an inside corner of the air passageway.

3. The air partition member claimed in claim 1 wherein the contours of each of said second section and said third section, at least, are further shaped and adapted to allow for the mating therewith of a second air partition member when used together to form an outside corner of the air passageway.

4. The air partition member claimed in claim 2 wherein the contours of each of said second section and said third section are further shaped and adapted to allow for the mating therewith of a second air partition member when used together to form an outside corner of the air passageway.

5. The air partition member claimed in either claims 1, 2, 3, or 4 further comprising means for securing said air partition member to said pedestal so as to prevent bowing of said air partition member when said air partition member is positioned vertically between the top surface of the sub-floor and the under surface of the raised floor and when said HVAC system is operational.

6. The air partition member claimed in either claims 1, 2, 3, or 4 wherein said first section includes a cutout portion intended to allow air to exit from the air passageway when the HVAC system is operational.

7. The air partition member claimed in claim 5 wherein said first section includes a cutout portion intended to allow air to exit from the air passageway when the HVAC system is operational.

8. The air partition member claimed in either claims 1, 2, 3, or 4 wherein a first portion of said first section and a second portion of said third section contiguous with said first portion along said third line includes a cutout to allow for the passage of electrical wires or the like through said air partition member.

9. The air partition member claimed in claim 5 wherein a first portion of said first section and a second portion of said third section contiguous with said first portion along said third line includes a cutout to allow for the passage of electrical wires or the like through said air partition member.

10. The air portion member claimed in claim 6 wherein a first portion of said first section and a second portion of said third section contiguous with said first portion along said third line includes a cutout to allow for the passage of electrical wires or the like through said air partition member.

11. An air partition member for use in forming an air passageway in an HVAC system, between a top surface of a sub-floor, the top surface having an irregular contour, and an undersurface of a raised floor positioned on a pedestal-stringer, floor support system, the air partition member comprising:

(a) a first section having a substantially rectangular shape defined by a perimeter including a first, second, third and fourth line, said first section extending laterally and longitudinally in a first plane between said first and second lines and between said third and fourth lines, said first and second lines defining respective lateral edges of said first section;

(b) a second section, integral with and having a pivotal connection to said first section along said fourth line, said second section bearing a first angular relationship to said first plane; and, (c) a third section integral with said first section along said third line, said third section extending upward from said third line when said air partition member is positioned vertically between the top surface of the sub-floor and the undersurface of the raised floor, said third section including a first segment, distal from said third line and extending substantially, laterally, between said lateral edges, said first segment adapted and contoured for engagement of at least one of the pedestal or stringer portions of the pedestal-stringer floor support system, to thereby suspend said air partition member substantially vertically when said air partition member is positioned vertically between the top surface of the sub-floor and the undersurface of the raised floor, said third section including a second segment, said second segment contoured and adaptable to adjust the vertical height of the air partition member so as to compensate for the effect of the irregular planarity of the top surface of the sub-floor.

12. An air partition member for use in forming an air passageway in an HVAC system, between a top surface of a sub-floor, the top surface having an irregular contour, and an undersurface of a raised floor positioned on a pedestal-stringer, floor support system, the air partition member comprising:

(a) a first section having a substantially rectangular shape defined by a perimeter including a first, second, third and fourth line, said first section extending laterally and longitudinally in a first plane between said first and second lines and between said third and fourth lines, said first and second lines defining respective lateral edges of said first section; and, (b) a second section integral with said first section along said third line, said second section extending upward from said third line when said air partition member is positioned vertically between the top surface of the sub-floor and the undersurface of the raised floor, said second section including a first segment, distal from said third line and extending substantially, laterally, between said lateral edges, said first segment adapted and contoured for engagement of at least one of the pedestal or stringer portions of the pedestal-stringer floor support system, to thereby suspend said air partition member substantially vertically when said air partition member is positioned vertically between the top surface of the sub-floor and the undersurface of the raised floor, said second section including a second segment, said second segment contoured and adaptable to adjust the vertical height of the air partition member so as to compensate for the effect of the irregular planarity of the top surface of the sub-floor.

13. An air passageway for an HVAC system between a top surface of a sub-floor, the top surface having an irregular contour, and an undersurface of a raised floor positioned on a pedestal-stringer, floor support system, the air passageway comprising:

(a) a first side;

(b) a second side spaced apart from said first side a fixed distance, said first and second sides, together with the top surface of the sub-floor and the undersurface of the raised floor forming the air passageway;

each of said first and second side including a plurality of respective, one-piece air partition members, each said air partition member including, (i) a first section having a substantially rectangular shape defined by a perimeter including a first, second, third and fourth line, said first section extending laterally and longitudinally in a first plane between said first and second lines and between said third and fourth lines, said first and second lines defining respective lateral edges of said first section;

(ii) a second section, integral with and having a pivotal connection to said first section along said fourth line, said second section bearing a first angular relationship to said first plane; and, (iii) a third section integral with said first section along said third line, said third section extending upward from said third line when said air partition member is positioned vertically between the top surface of the sub-floor and the undersurface of the raised floor, said third section including a first segment, distal from said third line and extending substantially, laterally, between said lateral edges, said first segment adapted and contoured for engagement of at least one of the pedestal or stringer portions of the pedestal-stringer floor support system, to thereby suspend said air partition member substantially vertically when said air partition member is positioned vertically between the top surface of the sub-floor and the undersurface of the raised floor, said third section including a second segment, said second segment contoured as a pleat, and thereby adaptable to adjust the vertical height of the air partition member so to compensate for the effect of the irregular planarity of the top surface of the sub-floor, said second section adapted to contact the top surface of the sub-floor and to compensate for the effect of the irregular planarity of the top surface of the sub-floor by pivoting about said flexing connection, at least one of said partition members having a respective first section including a cutout portion intended to allow air to exit from the air passageway when the HVAC system is operational.

14. A one-piece air partition member for use in forming an air passageway in an HVAC system, between a top surface of a sub-floor, the top surface having an irregular contour, and an undersurface of a raised floor positioned on a pedestal-stringer, floor support system, the air partition member comprising:

(a) a first section having a substantially rectangular shape defined by a perimeter including a first, second, third and fourth line, said first section extending laterally and longitudinally in a first plane between said first and second lines and between said third and fourth lines, said first and second lines defining respective lateral edges of said first section;

(b) a second section, integral with said first section along said fourth line, said second section bearing a first angular relationship to said first plane; and, (c) a third section integral with said first section along said third line, said third section extending upward from said third line when said air partition member is positioned vertically between the top surface of the sub-floor and the undersurface of the raised floor, said third section shaped and adapted, at least, to complement the contour of the pedestal-stringer floor support system to avoid an interference with the pedestal-stringer floor support system, said third section including a segment, distal from said third line and extending substantially, laterally, between said lateral edges, said segment further adapted and contoured for engagement of at least one of the pedestal or stringer portions of the pedestal-stringer floor support system, to thereby suspend said air partition member substantially vertically when said air partition member is positioned vertically between the top surface of the sub-floor and the undersurface of the raised floor, said second section adapted to vary the distance between said fourth line and the top surface of the sub-floor to compensate for the effect of the irregular planarity of the top surface of the sub-floor by flexing about said pivotal connection.

* * * * *

UNITED STATES PATENT AND TRADEMARK OFFICE

CERTIFICATE OF CORRECTION

PATENT NO. : 6,604,993 B1
DATED : August 12, 2003
INVENTOR(S) : Andrew Boniface

It is certified that error appears in the above-identified patent and that said Letters Patent is hereby corrected as shown below:

Column 10,
Line 59, change the phrase “third section” to -- second section --.
Line 60, change the phrase “third line” to -- fourth line --.
Line 65, change the phrase “third section” to -- second section --.
Line 66, change the phrase “third line” to -- fourth line --.

Column 11,
Line 3, change the phrase “third section” to -- second section --.
Line 4, change the phrase “third line” to -- fourth line --.

Signed and Sealed this

Tenth Day of February, 2004

JON W. DUDAS
*Acting Director of the United States Patent and Trademark Office*